United States Patent [19]

Morooka et al.

[11] 4,292,825

[45] Oct. 6, 1981

[54] GAUGE AND TENSION CONTROL SYSTEM FOR TANDEM ROLLING MILL

[75] Inventors: Yasuo Morooka; Shinya Tanifuji; Masaya Tanuma, all of Hitachi, Japan

[73] Assignee: Hitachi, Ltd., Tokyo, Japan

[21] Appl. No.: 123,418

[22] Filed: Feb. 21, 1980

[30] Foreign Application Priority Data

Feb. 23, 1979 [JP] Japan ..... 54/19663

[51] Int. Cl.[3] ..... B21B 37/00

[52] U.S. Cl. ..... 72/8; 72/16; 72/19

[58] Field of Search ..... 72/6, 8, 10, 11, 16, 72/19

[56] References Cited

U.S. PATENT DOCUMENTS

| | | | |
|---|---|---|---|
| 3,600,920 | 8/1971 | Smith, Jr. | 72/8 |
| 3,940,960 | 3/1976 | Tanifuji et al. | 72/19 |
| 4,030,326 | 6/1977 | Morooka et al. | 72/8 |
| 4,137,742 | 2/1979 | Tanifuji et al. | 72/6 |

FOREIGN PATENT DOCUMENTS

| | | |
|---|---|---|
| 11767/76 | 9/1977 | Australia . |
| 2713301 | 10/1977 | Fed. Rep. of Germany . |
| 53-44207 | of 1978 | Japan . |

*Primary Examiner*—Milton S. Mehr

*Attorney, Agent, or Firm*—Craig and Antonelli

[57] ABSTRACT

A gauge and tension control system for a tandem mill comprises a delivered strip thickness deviation calculating unit for detecting output strip thickness at each of rolling stands, a tension calculating unit for arithmetically determining interstand tensions between two adjacent rolling stands on the basis of armature currents of drive motors and rolling loads at every rolling stand, a memory unit supplied with the output from the delivered strip thickness deviation calculating unit and detecting rolling speed values to thereby produce input strip thicknesses at every rolling stand, an optimal control unit for arithmetically determining optimal speed control quantity and press-down control quantity on the basis of the outputs from the delivered strip thickness deviation calculating unit, the tension calculating unit, the memory unit and a rolling schedule, a speed controller for controlling the speeds of the roll drive motors in dependence on the speed control quantities and a press-down controller for controlling the screw-down position of the rolling stands in dependence on the associated press-down control quantity.

4 Claims, 4 Drawing Figures

GAUGE AND TENSION CONTROL SYSTEM FOR TANDEM ROLLING MILL

The present invention generally relates to a control system for a tandem rolling mill. In more particular, the invention concerns a control system for controllably setting the gauge of a rolled strip delivered from the output side of a tandem mill as well as interstand tensions applied to the strip between adjacent rolling stands at respective desired values.

As a control system for the tandem rolling mill, there has been heretofore well known an automatic gauge control system (also referred to hereinafter as AGC system in abridgement) which is primarily destined for controlling the thickness of a strip or plate material as rolled to a desired value. Additionally, an automatic tension control system (also referred to hereinafter as ATC system) has also been familiar which serves to control tensions applied to the strip being rolled between the adjacent stands of the tandem rolling mills. Such tension is often termed as the interstand tension. Various types of AGC and ATC systems have been proposed. For example, there may be enumerated AGC system of a gauge meter type which is operative on the basis of Hook's low as well as AGC system which is based on the low of constancy of mass flow. Reference may be made to U.S. Pat. Nos. 3,600,920 and 4,030,326. Additionally, an AGC system in which gauge meters or thickness detectors are installed to thereby control the thickness of a strip to be rolled so that thickness deviation representing difference between the actual thickness derived from the output of the gauge meter and a desired thickness value is reduced to zero has been hitherto known. Of course, a combination of the different type AGC systems has also been proposed, an example of which is disclosed in DOS No. 2713301. As the ATC system, it is known to detect directly the interstand tension by means of a tension meter, whereby control is made so that deviation in tension from a desired value is compensated to zero (this system is primarily used for the cold tandem mills). For the control of the hot tandem mills, a tension control system in which a looper is made use of is frequently employed. Further, an ATC control system in which deviation in tension is indirectly determined (i.e. through arithmetic operation) on the basis of detected rolling loads driving power (e.g. electric current) and the like factors and the control is made to reduce the deviation to zero (refer to U.S. Pat. No. 3,940,960, for example).

It should be pointed out here that the hitherto known AGC and ATC systems are so constructed and used as to control individually and separately only the gauge (thickness) and the interstand tension, respectively. There has been known no proposal as to a control system which is capable of controlling coordinately both the gauge and the tension at optimum. In other words, the conventional AGC and ATC systems are operated independently from each other, which results in occurrence of mutual interference between both systems, providing a cause for making it difficult to accomplish an enhanced control accuracy. More specifically, in the tandem mill, variation in tension brings about a corresponding variation in thickness of a strip material being rolled, while variation in thickness is accompanied by a corresponding variation in tension, as is well known. Consequently, difference in response capability or sensitivity between the AGC and the ATC systems gives rise to occurrence of mutual interference in operations of both system, involving a hunting or the like undesirable phenomenons. Under the circumstances, the control capabilities of the individual control systems can not be fully developed.

In the case of the hot tandem mill, a looper is used for the tension control, as described hereinbefore. However, use of the looper is disadvantageous for practical application in that time-consuming and laborious procedures are required for the maintenance because of the looper being composed of purely mechanical elements. Further, in view of the fact that the looper is disposed between the adjacent rolling stands in the hot tandem mill, it is extremely difficult, not to say impossible, to install detectors and controllers for improving the control accuracy as well as the manipulatability of the tandem mill.

An object of the invention is to provide a control system for tandem rolling mills which can solve and overcome the problems and difficulties of the hitherto known control systems as described above.

According to an aspect of the invention, actual quantities of thickness and tension of a strip material being rolled are periodically measured at a predetermined time interval and made use of for determining correcting quantities for a roll gap and a roll rotation speed for a succeeding rolling operation thereby to control so that variance or dispersion of variations in thickness and tension is minimum. The thickness measurement or detection is effected through a gauge meter which is operative on the basis of Hook's low or a mass flow meter based on the low of constancy of mass flow, wherein the control is made in dependence on the thickness value arithmetically determined from the measurement signal derived from the gauge meter or mass flow meter after the signal representative of the arithmetically determined thickness value has been passed through a filter which is designed in consideration of dispersion of noise. The value of tension as measured is arithmetically determined on the basis of relationship between torque of a driving motor and a rolling pressure and utilized for the tension control after filtering in a similar manner as the thickness signal. There is provided a roll rotation speed controller which exhibits a load control function to prevent the roll rotation speed from being changed even when an abrupt variation occurs in a rolling load as well as a function to control rapidly a speed ratio to be corrected for controlling the strip thickness to a desired value. Thus, according to a feature of the invention, there is provided a continuous or tandem mill including at least two rolling stands, which tandem mill comprises means for detecting thickness of a strip material delivered from each of the rolling stands, means for detecting interstand tension applied to the strip material between two successive rolling stands, transfer means for shifting signals representing the thicknesses of the strip delivered from the individual rolling stands as a function of a feeding speed of the strip material being rolled, means for setting desired values for the thickness and the interstand tension, respectively, at each of the rolling stands, and means for correctively controlling a roll gap or a roll rotation speed at each of the rolling stands on the basis of the desired values set for the strip thickness and the interstand tension as well as the detected thickness value of the delivered strip, the shifted thickness value produced from the transfer means and the detected tension value at the associated rolling stand so that dispersion of deviations in the detected thickness and tension is reduced to a minimum within a succeeding predetermined time interval.

The other objects, features and advantages of the invention will become more apparent from the following description as well as the accompanying drawings in which.

Figure 1:
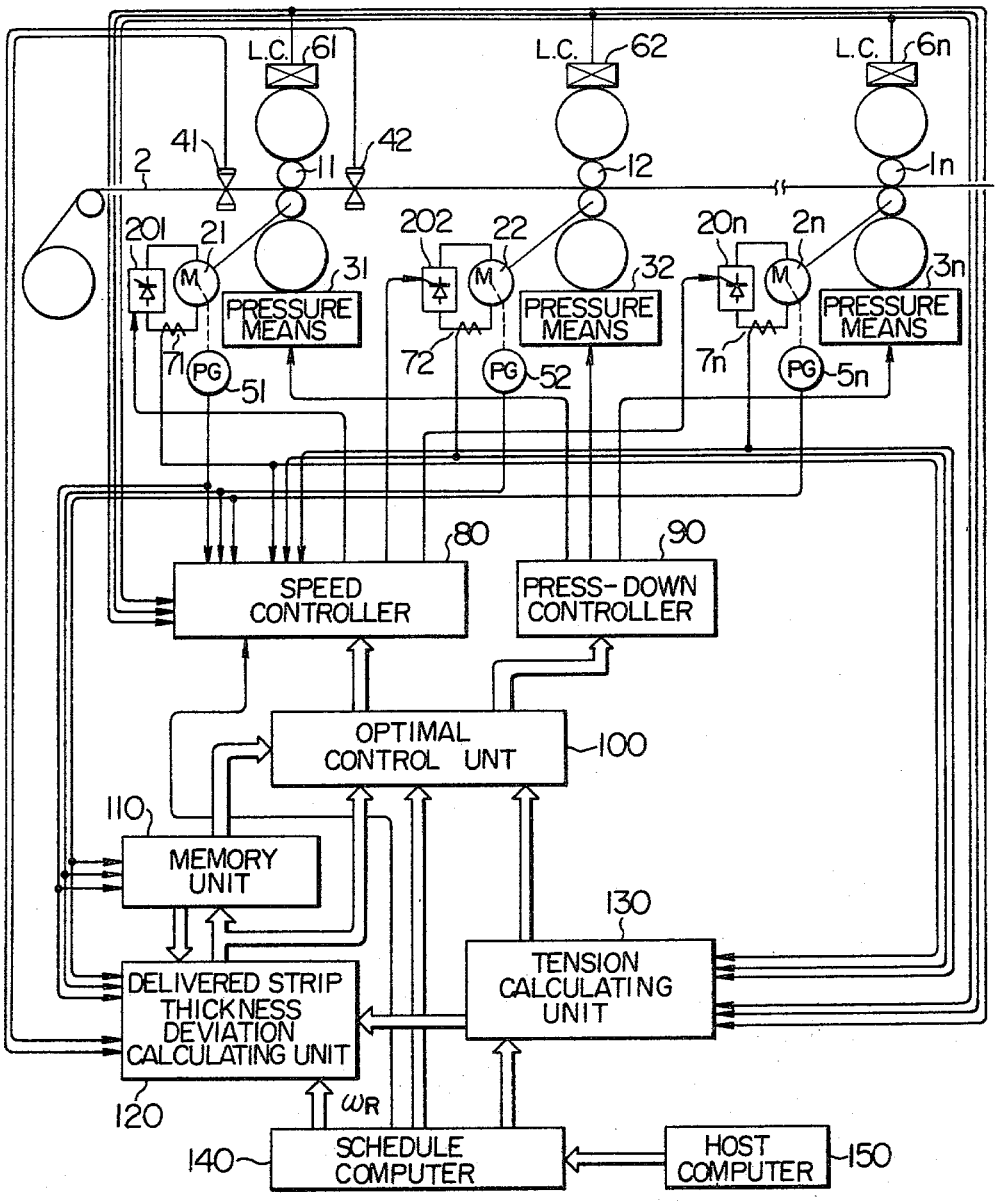
FIG. 1 is a block diagram to show an embodiment of the present invention.

In the first place, the principle of the invention will be described in detail.

The thickness (hereinafter referred to as the output thickness or delivered strip thickness) of a strip delivered from each of rolling stands in a tandem mill will vary in dependence on change in a roll gap as well as the tension, deformation resistance and the input thickness of the strip material being rolled, as is well known. Now, it is assumed that, at a given sampling time $\tau = kT$ where T is a sampling period and k is an integer, deviation of the output thickness from a desired value at the i-th rolling stand is represented by $\Delta h_{io}$, the input thickness is represented by $H_{io}$, the deviations in front tension and back tension are represented by $\Delta t_{io}$ and $\Delta t_{i-10}$, respectively, while $\Delta S_i$ represents a value for correcting the roll gap and $\Delta v_{Ri}$ represents a value for correcting the roll rotation speed, both of $\Delta S_i$ and $v_i$ being obtained through arithmetic operation for determining the optimal control quantity. On the other hand, at a given time $\tau$ after any sampling time, the input thickness is represented by $H(\tau)$, the deformation resistance is represented by $k_p(\tau)$, deviation in the output thickness is represented by $\Delta h(\tau)$ and deviation in the front tension is represented by $\Delta t(\tau)$. Further it is assumed that transfer functions of a rolling force (press-down force) controller and a roll speed controller are, respectively, given by $$G_s(\tau) = 1 - e^{-\frac{\tau - Ls}{Ts}} \tag{1}$$

$$G_v(\tau) = 1 - e^{-\frac{\tau - Lv}{Tv}} \tag{2}$$

where

Ts is a time constant of the rolling force controller,
Ls is an idling time of the rolling force controller,
Tv is a time constant of the speed controller, and
Lv is an idle time of the speed controller.

From Hook's law $$h = s + P/K \tag{3}$$

where P is a rolling load, K is a mill stiffness coefficient and s is the roll gap, it is apparent that the rolling load P is a function of the thickness, tension and the deformation resistance. Thus, the thickness deviation $\Delta h_i$ can be expressed as follows:

$$\Delta h_i = \Delta s_i + \frac{\Delta Pi}{K} = \Delta s_i + \frac{1}{K}\left\{\left(\frac{\partial P}{\partial h}\right)\Delta h_i + \left(\frac{\partial P}{\partial H}\right)\Delta H_i + \frac{\partial P}{\partial t_i}\Delta t_i + \left(\frac{\partial P}{\partial t_{i-1}}\right)\Delta t_{i-1} + \left(\frac{\partial P}{\partial k_p}\right)\Delta k_p\right\} \tag{4}$$

From the above equation, deviation in the output thickness $\Delta h_i(\tau)$ at the given time $\tau$ can be estimated from the following expression:

$$\Delta h_i(\tau) = \frac{K}{K - \left(\frac{\partial P}{\partial h}\right)}\Delta S_i(\tau) + \frac{\left(\frac{\partial P}{\partial H}\right)}{K - \left(\frac{\partial P}{\partial h}\right)}\Delta H_i(\tau) + \frac{\left(\frac{\partial P}{\partial t_i}\right)}{K - \left(\frac{\partial P}{\partial h}\right)}\Delta t_i(\tau) + \frac{\left(\frac{\partial P}{\partial t_{i-1}}\right)}{K - \left(\frac{\partial P}{\partial h}\right)}\Delta t_{i-1}(\tau) + \frac{\left(\frac{\partial P}{\partial k_p}\right)}{K - \left(\frac{\partial P}{\partial h}\right)}\Delta k_p(\tau) \tag{5}$$

The above expression applies valied at the sampling time $\tau = 0$. When $\Delta s_i$ and $\Delta t_i$ are replaced by deviations from the respective sampled values appearing at a certain time succeeding to the sampling time, then at $\tau = kT$, $$\Delta h_i(\tau) = \Delta h_{io} + \eta s_i \Delta s_i \cdot G_s(\tau) + \eta H_i(\Delta H_i(\tau) - \Delta H_{io}) + \eta t_i(\Delta t_i(\tau) - \Delta t_{io}) + \eta t_{i-1}[\Delta t_{i-1}(\tau) - \Delta t_{i-10}] + \eta k_{pi}(\Delta k_{pi}(\tau) - \Delta k_{pio}) \tag{6}$$

where $$\eta t_i = \frac{(\partial P/\partial x)}{K - \partial P/\partial h}.$$

In a similar manner, the expression for the thickness deviation is derived from the low of constancy of flow mass. Namely, $$H_i V_{ei} = h_i V_{oi} \tag{7}$$

where $V_e$ is a strip speed at the input side of a given rolling stand, and $V_o$ is a delivered or output strip speed where $V_{ei} = V_{oi-1}$. The delivered strip speed $V_{oi}$ at the i-th stand is given by $$V_{oi} = V_{Ri}(1 + f_i) \tag{8}$$

where $V_{Ri}$ is the roll speed and $f_i$ is a forward slip.

From the formula (7), $$\frac{\Delta h_i(\tau)}{h_i} = \frac{\Delta V_{Ri-1}(\tau)}{V_{Ri-1}} + \frac{\Delta f_{i-1}(\tau)}{1 + f_{i-1}} + \frac{\Delta H_i(\tau)}{H_i} - \frac{\Delta V_{Ri}(\tau)}{V_{Ri}} - \frac{\Delta f_i(\tau)}{1 + f_i} \tag{9}$$

where $$\Delta f_i(\tau) = \left(\frac{\partial f}{\partial h}\right) \Delta h_i(\tau) + \left(\frac{\partial f}{\partial H}\right) \Delta H_i(\tau) + \left(\frac{\partial f}{\partial t_{i-1}}\right) \Delta t_{i-1}(\tau) + \left(\frac{\partial f}{\partial t_i}\right) \Delta t_i(\tau) + \left(\frac{\partial f}{\partial k_p}\right) \Delta k_{pi}(\tau) \quad (10)$$

From the equations (9) and (10), $$\begin{aligned}\Delta h_i(\tau) = {} & \Delta h_{io} + \psi V_{i-1}\Delta V_{Ri-1} \cdot G_v(\tau) + \psi h_{i-1}[\Delta h_{i-1}(\tau) - \\ & \Delta h_{i-10}) + \psi H_{i-1}[\Delta H_{i-1}(\tau) - \Delta H_{i-10}] + \\ & \psi t_{i-2}[\Delta t_{i-2}(\tau) - \Delta t_{i-20}) + \psi t_{i-1}[\Delta t_{i-1}(\tau) - \\ & \Delta t_{i-10}) + \psi k_{pi-1}[\Delta k_{pi-1}(\tau) - \Delta k_{pi-10}) + \\ & \psi H_i[\Delta H_i(\tau) - \Delta H_{io}] + \psi v_i \Delta V_{Ri} G_v(\tau) + \\ & \psi t_i[\Delta t_i(\tau) - \Delta t_{io}] + \psi k_{pi}[\Delta k_{pi}(\tau) - \Delta k_{pio}]\end{aligned} \quad (11)$$

From equations (6) and (11), a vector equation is obtained as follows:

$$AX(\tau) = AX_o + BY \cdot G(\tau) + CZ(\tau) \quad (12)$$

where

A represents a coefficient matrix constituted by $\eta h_i$, $\psi h_i$, $\eta t_i$ and $\psi t_i$, B represents a coefficient matrix constituted by $\eta s_i$ and $\psi v_i$ C represents a coefficient matrix constituted by $\eta H_i$, $\eta h_i$, $\eta t_i$, $\eta k_{pi}$, $\psi H_i$, $\psi h_i$, $\psi t_i$, $\psi k_{pi}$ and $$X = [\ldots \Delta h_i(\tau), \Delta t_i(\tau) \ldots]^T$$

$$Y = [\ldots \Delta s_i, \Delta V_{Ri} \ldots]^T$$

$$G = [\ldots G_s(\tau), G_v(\tau) \ldots]^T \text{ and}$$

$$Z = [\ldots \Delta h_{io}, \Delta t_{io}, \Delta H_i(\tau), \Delta H_{io}, \Delta k_{pi}(\tau) \ldots]^T$$

The above equation shows an aspect of changes in the output thickness and interstand tension at each of the rolling stands as a function of time elapse after the sampling. Minimization of dispersions of $\Delta h_i(\tau)$ and $\Delta t_i(\tau t)$ in a time interval $0 \leqq \tau \leqq kT$ are determined. Namely, $$J = \sum_i^m \int_o^{nT} [\Delta h_i^2(\tau) + \Delta t_i^2(\tau)] d\tau = \int_o^{nT} X^T X d\tau \quad (13)$$

The value of Y at which J is minimized is obtained by solving the following simultaneous equations:

$$\left.\begin{aligned}\frac{\partial J}{\partial \Delta s_i} &= O \\ \frac{\partial J}{\partial V_{Ri}} &= O\end{aligned}\right\} \quad (14)$$

Accordingly, $$Y = -\frac{X_o \int_o^{nT} G(\tau) d\tau + A^{-1}C \int_o^{nT} G(\tau) Z(\tau) d\tau}{A^{-1}B \int_o^{nT} G^2(\tau) d\tau} \quad (15)$$

Since $G(\tau)$ is the function known from the expressions (1) and (2), while $Z(\tau)$ is also a known function as will be described hereinafter, arithmetic operations may be executed at every sampling time to determine a solution of Y which represents the optimal control quantity.

Next, process for determining $X_o$ in the equation (15), that is, determination of the output thickness $\Delta h_{io}$ and the interstand tention $\Delta t_{io}$ at each rolling mill at each sampling time will be described.

Although it is possible to determine the output thickness $\Delta h_{io}$ on the basis of the expression (3) by making use of Hook's low in a conventional manner, the process adopted for determining this quantity is preferably based on the low of constancy of mass flow in order to abate the otherwise influential factors such as eccentricity, wear, thermal expansion and the like of the rolls.

As can be seen from the formula (7), the input mass flow at the i-th rolling stand is equal to the output mass flow at the same stand. From the simultaneous equations (9) and (10), it is possible to arithmetically determine $\Delta h_{io}$ at the sampling point. In this connection, the input strip speed $V_{e1}$ at the first rolling stand may be directly measured by a strip speed meter or alternatively $\Delta h_{io}$ is detected by a thickness gauge.

The tension can be directly detected by a tension gauge if installed. In the absence of the tension gauge, the tension is arithmetically determined on the basis of the following relation:

$$G_i = 2l_i P_i - R_i(T_i - T_{i-1}) \quad (16)$$

where $T_i$ represent a total tension which can be expressed relative to the unit tension $t_i$ as follows:

$$T_i = h_i \cdot b \cdot t_i \quad (17)$$

The simbol $l_i$ represents the length of torque arm the initial value of which can be determined from $G_i$ and $P_i$ by making use of the fact that the front tension $T_i$ is equal to zero so long as the strip having been nipped at the i-th rolling stand is short of being nipped at the (i−1)-th stand. In connection with the torque arm during the rolling operation, deviation $\Delta l$ thereof from the initial value is set as an unknown quantity and the expression (16) is prepared so as to apply to all the rolling stands. Then, it is possible to determine $T_i$ as a solution of simultaneous equations in which $\Delta l$ and $T_i$ are contained as the unknown quantities, as described in detail in U.S. Pat. No. 4,137,742.

When the unit tension is to be determined on the basis of the formula (17) it is necessary to know the strip thickness $h_i$. In this case, the total tension is mathematically determined from the equation (16), and $\Delta t_{io}$ which is determined from $$\frac{\Delta T}{T_{pi}} = \frac{\Delta h_i}{h_{pi}} + \frac{\Delta t_{io}}{t_i} \quad (18)$$

is put in the equation (10) while $\Delta h_{io}$ determined from the expressions (9) and (10) is placed in the equation (18) thereby to determine $\Delta h_i$.

In the foregoing, description has been made in detail on the detection of the strip thickness and tension as well as the control system. It should however be added that no valid tension can be detected when a sag occurs in the strip material being rolled. Accordingly, it is indispensable to provide control means for preventing the occurrence of sag or droop in the strip material being rolled. Such sag will occur at the upstream or downstream side of the rolling stand when the output torque produced from a roll drive motor is inadequate for the required rolling force or when the torque is excessively high to thereby involve variation in the rotating speed of the drive motor. Thus, according to a feature of the invention, the output torque of the drive motor is adapted to be controlled in dependence on the required rolling force. More specifically, the rolling torque which can be determined from the rolling load and tension on the basis of the expression (16) is utilized for controlling the electric current supplied to the drive motor in proportional dependence on the rolling load, as will be described hereinafter in conjunction with FIGS. 3 and 4.

Further, as another technical problem to be considered, there is a speed matching control for matching the rotating speeds of the drive motors to one another. Generally, D.C. motors of different capacities are used in the tandem mill. Consequently, there arises frequently such situation where some motors are under the speed control in a voltage regulating range, while the others are controlled in a field weakening control range, when the motor speeds are to be accelerated or decelerated. In such case, the coordinated speed state established among the drive motors will be disturbed, to thereby bring about variation in tension of the strip material. According to an aspect of the invention, all the drive motors are monitored in respect of the rotating conditions and the control ranges so as to be controlled as a whole in such a manner as disclosed in Japanese Laid-Open patent application No. 44207/1978 of the same inventors as those of the present application.

Now, an exemplary embodiment of the invention will be described by referring to FIG. 1.

Figure 2:
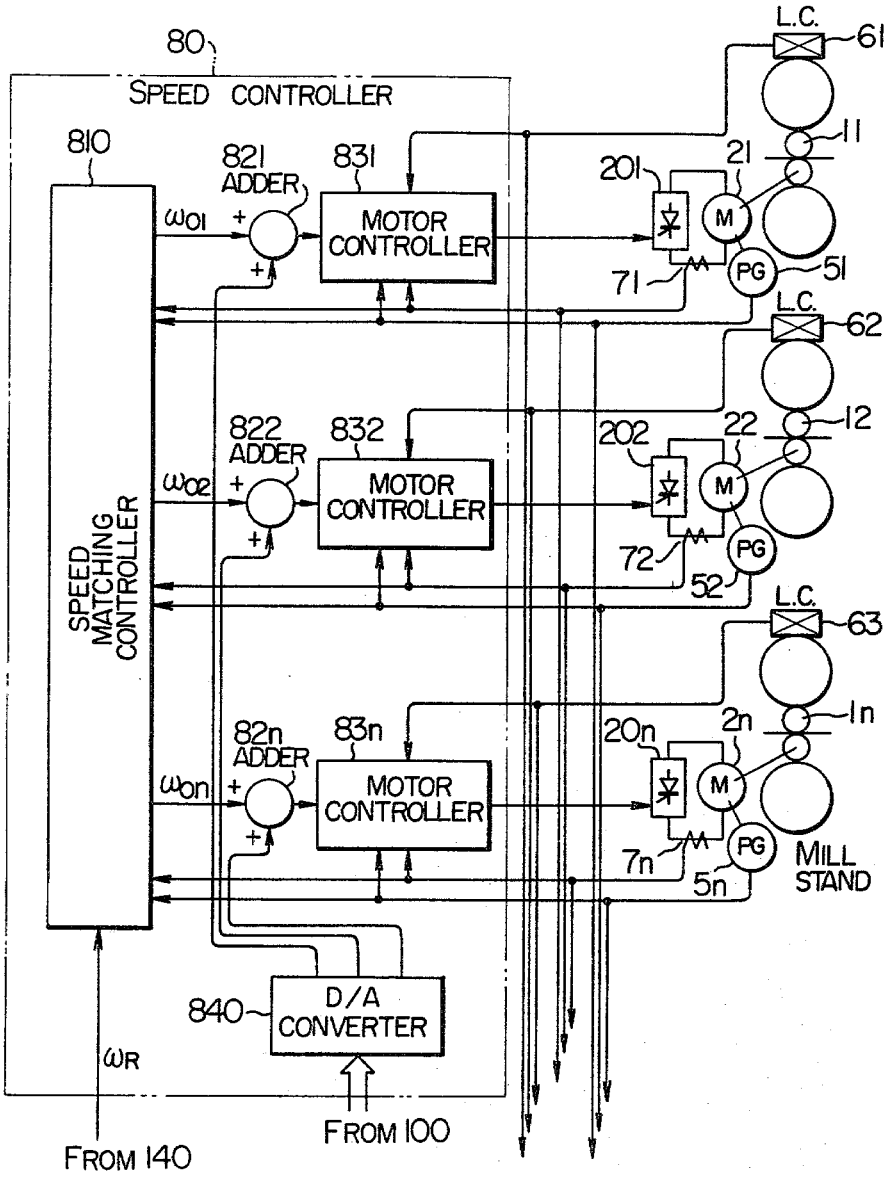
FIG. 2 is a block diagram illustrating a typical hardware arrangement of a speed controller used in the control system shown in FIG. 1.

In the figure, numerals 11 to 1*n* denote individual rolling stands, 21 to 2*n* denote roll drive motors, 31 to 3*n* denote pressure means (screw-down devices), 41 and 42 designate thickness gauges provided at the input and the output sides of the first stand, respectively, 51 to 5*n* denote speed detectors, 61 to 6*n* denote load cells for detecting the rolling forces or loads at the associated stands, 71 to 7*n* denote transducer for detecting electric currents supplied to the drive motors 21 to 2*n*, and numeral 80 denotes a speed controller an arrangement of which is shown in FIG. 2. Numeral 90 denotes a press-down controller and 100 denotes an optimal control unit for minimizing the dispersion of deviations through operation in accordance with the expression (15), as described in detail hereinbefore in conjunction with the principle of the invention. Numeral 110 denotes a memory unit having a function of tracking the sampled point of the strip whose thickness is measured at the output side of a given stand thereby to transfer the output thickness according to transportation speed of the sampled point up to the next stand and to output the transferred output thickness when the sampled point reaches the next stand, so that the output represents the input thickness of the strip at the next stand. Numeral 120 denotes an output thickness calculating unit for arithmetically determining the thicknesses of the strip material delivered from the individual rolling stands, 130 denotes a tension calculating unit, 140 denotes a schedule computer for arithmetically determining control gain for the influential factor or the forward slip as well as the desired output thickness at the individual stands and the desired interstand tensions for every strip rolling schedule, which in turn is provided by a host computer 150. Numerals 201 to 20*n* denote power supply sources composed of thyristors.

Before initiation of the rolling operation, the desired thickness as well as the desired interstand tensions are input to the schedule computer 140 from the host computer 150. The schedule computer 140 arithmetically determines the forward slip on the basis of the input rolling schedule. A process of such arithmetic determination is briefly reported by one of the present inventors in Electric Academy Periodical, vol. 92-C, No. 2, p.p. 100–109. The results of the arithmetic operation are supplied to the delivered strip thickness (output thickness) deviation calculator unit 120, the tension calculating unit 130 and the optimal control unit 100.

When the rolling operation is initiated, the tension calculating unit 130 is supplied with the motor current signals produced from the transducers 71 to 7*n* and representing the currents supplied to the drive motors 61 to 61*n* to thereby arithmetically determine the interstand tensions between the adjacent stands on the basis of the expression (16). The result of the calculation is supplied to the delivered strip thickness deviation calculating unit 120 which is further supplied the speed signals from the speed detectors 51 to 5*n* and the thickness signals from thickness gauges 41, 42, to thereby calculate the delivered strip thickness deviations at the individual stands in accordance with the expressions (3) and (10). The results of calculation are then fed to the memory unit 110 and the optimal control unit 100. The memory unit 110 is supplied with the speed signals from the strip feeding speed detectors 51 to 5*n* to thereby vary the strip thickness for every predetermined small distance interval. In practice, data of delay time corresponding to the feeding speeds are stored in the memory unit 110. The optimal control unit 100 executes arithmetic operation in accordance with the expression (15) to output the optimal control quantity thus determined to the speed controller 80 and the press-down controller 90.

FIG. 2 shows an exemplary embodiment of the speed controller 80 enclosed in a double-dotted broken line block. The controller 80 is composed of a speed matching controller 810, adders 821 to 82*n*, motor controllers 831 to 83*n* and a digital-to-analog or D/A converter 840. The speed matching controller 810 is supplied with the data signal representing the speed schedule for a reference rolling stand from the schedule computer together with the signals representing the armature currents of the drive motors as detected by the transducers 71 to 7*n* as well as the signals representing the speeds of the drive motors from the speed detectors 51 to 5*n*, thereby to produce reference speed command signals $\omega_{01}$ to $\omega_{0n}$ for the motors 21 to 2*n* driving the respective rolling stands. The speed command signals $\omega_{01}$ to $\omega_{0n}$ are supplied to the adders 821 to 82*n*, respectively, at one inputs thereof. On the other hand, the D/A converter 820 is supplied with the digital speed control signals from the optimal control unit 100 for setting and maintaining the strip thickness and the tension at the respective desired values at the individual rolling stands. The digital control signals are thus converted into corresponding analog control signals which are then applied to the other input terminals of the associated adders 821 to 82*n*. As the consequence, these adders 821 to 82*n* produce the speed control command signals each of which is composed of the reference speed command signal added with the speed control signal for controlling the tension and the strip thickness. The speed control command signals are then supplied to the motor controllers 831 to 83*n*, respectively, which are further supplied with the rolling load signals (outputs from the load cells 61 to 6n), signals representing the armature currents of the drive motors (the outputs from the transducers 71 to 7n) and the motor speed signals (output from the feeding speed detectors 51 to 5n), to thereby control the speeds of the drive motors 21 to 2n for the individual rolling stands to the values designated by the associated speed control command signals.

Figure 3:
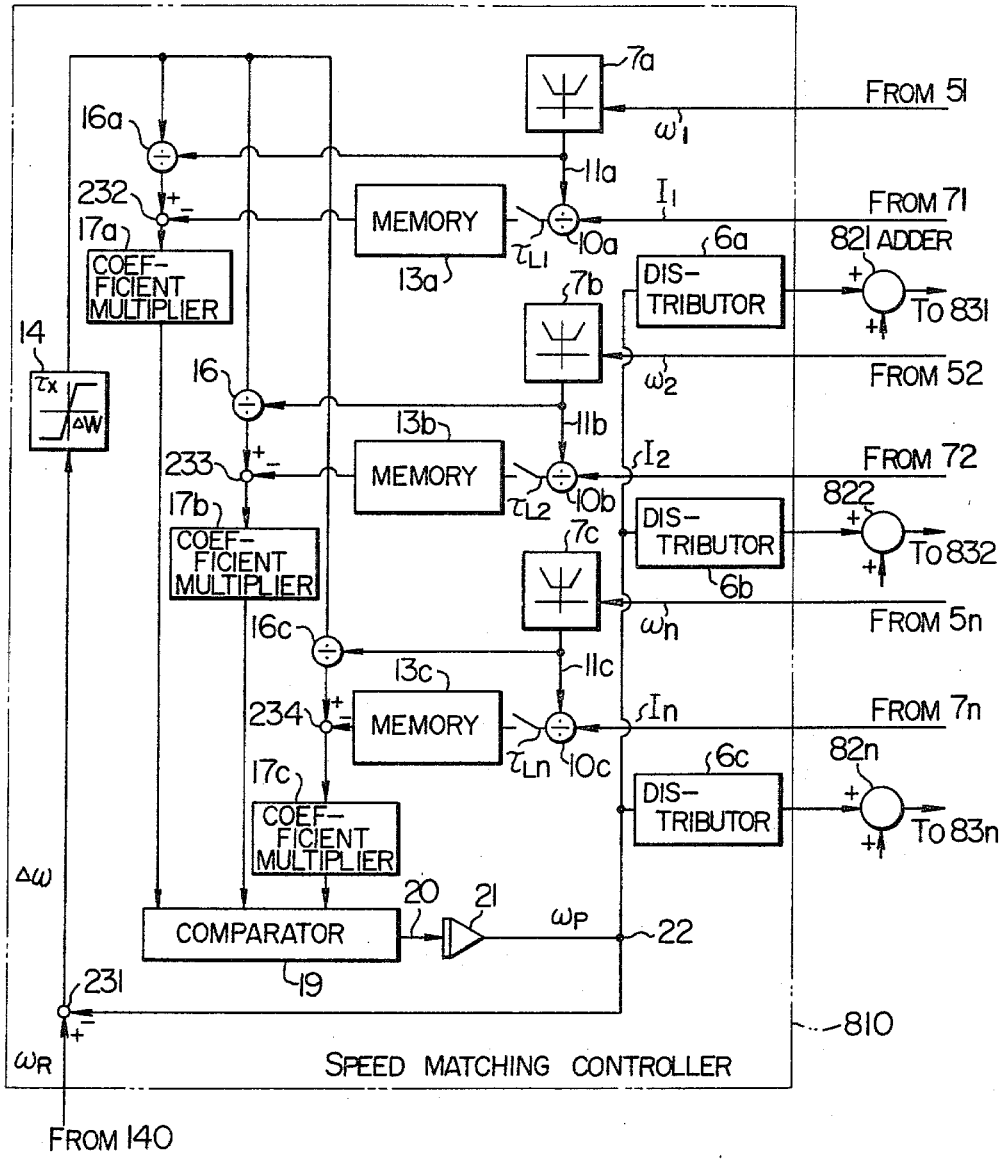
FIG. 3 is a block diagram illustrating a typical hardware arrangement of a speed matching controller shown in FIG. 2.

FIG. 3 shows an exemplary embodiment of the speed matching controller 810 employed in the speed controller 80 which serves to control the overall rolling speed $\omega_P$ while monitoring the matched speed conditions and the permissible torques of the individual drive motors, as described hereinbefore. The overall rolling speed signal $\omega_P$ is converted to the individual speed commands for the associated rolling stands through distributors 6a to 6c. The distributed speed command outputs from the distributors 6a to 6c are then fed to the adders 821 to 82n, respectively. The output from the optimal control unit 100 is supplied to the adders 821 to 82n to correctively modify the speed command values $\omega_{01}$ to $\omega_{0n}$ for the individual mill stands. The modified speed command values are then supplied to the motor controllers 831 to 83n. Referring to FIG. 3, the distributors 6a to 6c serve to convert the speed command signal $\omega_P$ to the individual motor speeds in accordance with the speed ratios assigned to the individual drive motors. Symbols 7a to 7c designate function generators which are supplied with the output signals $\omega_1$, $\omega_2$ and $\omega_n$ from the speed detectors 51, 52 and 5n, respectively. When the speed $\omega_i$ is lower than a base speed, i.e. $\omega_i<1$, the associated function generator produces the speed range value $\Omega_i=1$. On the other hand, when the speed $\omega_i$ is not lower than the base speed $\omega_i$, i.e. $\omega_i \geqq 1$, then the function generator produces the speed range signal $\Omega_i$ which is equal to $\omega_i$ at this time. Reference characters 10a to 10c designate dividers which serve to divide the output values $I_1$ to $I_n$ of the current detectors 71 to 7n by the speed range values $\Omega_i$ (11a to 11c) to thereby produce the load torque signals $\tau_{Li}$. Characters 13a to 13c denote memories which operate to store the relevant load torques $\tau_{Li}$ only when the reference speed value $\omega_R$ undergoes variation. In this connection, it will be noted that the suffix i is used to identify the individual stand, where i=1, 2, . . . , n. Reference numeral 14 denotes a maximum torque generator which produces an output $\tau_X$ for acceleration (i.e. when $\Delta\omega>0$ where $\Delta\omega$ represents, difference between the desired value $\omega_R$ and the command value $\omega_P$) and produces $-\tau_X$ for the deceleration (i.e. when $\Delta\omega<0$). The symbol $|\tau_X|$ represents the maximum magnitude of the motor torque. Numeral 16 denotes a divider serving to divide the maximum torque $\tau_X$ by the speed range value $\Omega_i$ thereby to output a maximum permissible torque $\tau_X/\Omega_i$ in dependence on the strip feeding speeds at the individual rolling stands. Numerals 17a to 17c designate coefficient multipliers which serve to convert the maximum accelerating or decelerating torque which corresponds to difference between the output from the divider 16 and the output value of the memories 13a to 13c into accelerating or decelerating speed signal for the final rolling stand. The coefficient is a reciprocal of a product of the rated accelerating time $T_{Ai}$ and the speed ratio $\gamma_i$, i.e. $1/(T_{Ai}\cdot\gamma_i)$. Reference numeral 19 denotes a comparator which is supplied at the inputs thereof with the maximum acceleration or deceleration signal $(1/T_{Ai}\cdot\gamma_i)$ for the individual motors to select the minimum value thereof to output the optimal acceleration or deceleration signal 20. Reference 21 denotes an integrator for integrating the optimal acceleration or deceleration signal 20 to produce at the output thereof the speed command signal $\omega_P$. Numerals 231 to 234 denote subtractors.

For details of the speed matching controller shown in FIG. 3, reference is to be made to Japanese Pat. No. 44207/1978.

Figure 4:
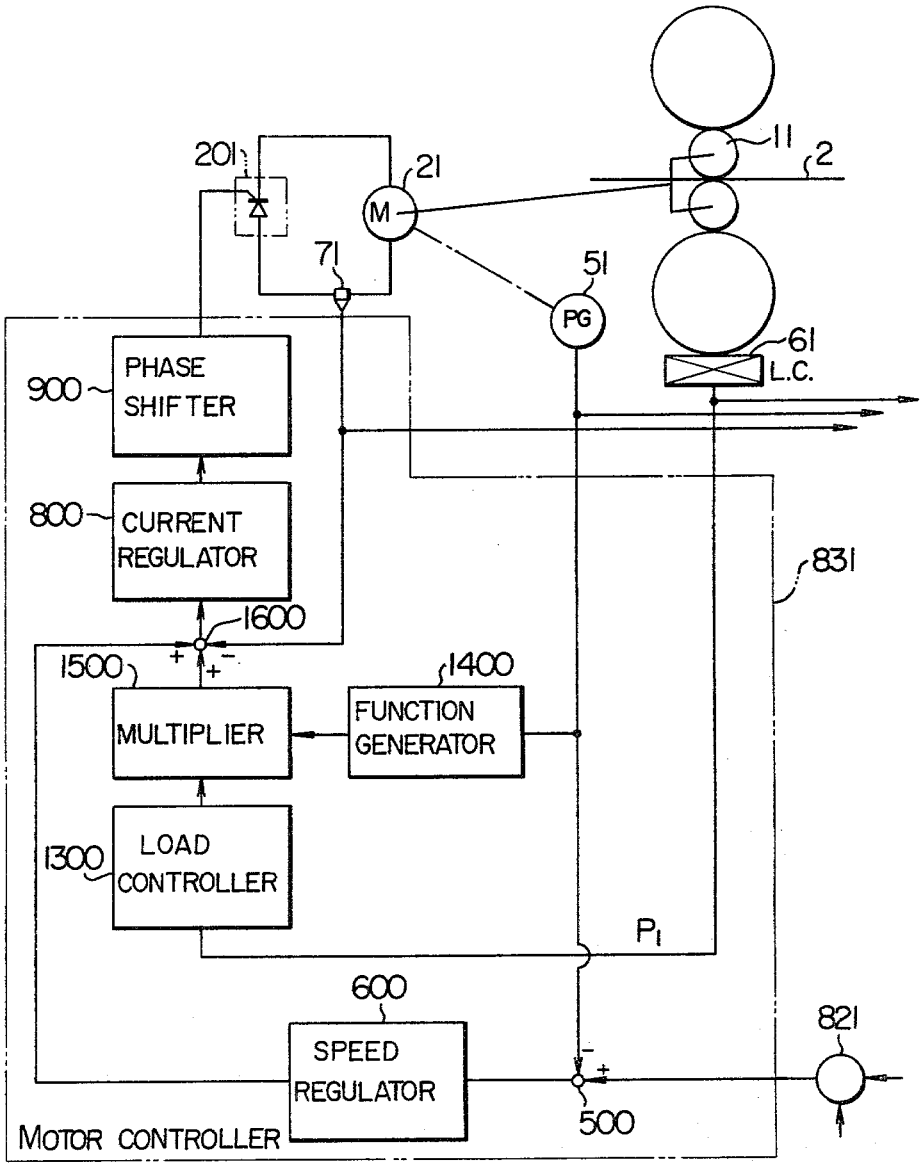
FIG. 4 is a block diagram illustrating a typical hardware arrangement of a motor controller shown in FIG. 2.

The speed command signals output from the adders 821 to 82n are applied to the motor controllers 831 to 83n, respectively. A typical circuit arrangement of one (831) of such motor controllers is shown in FIG. 4. In this figure, reference numeral 500 denotes a subtractor, 600 a speed regulator, 800 a current regulator, and 900 denotes a phase shifter of a firing pulse controlled type. Numeral 1300 designates a load control unit for converting the rolling load $P_1$ into a motor load, and 1400 designates a function generator serving for speed compensation. Finally, numeral 1500 denotes a multiplier. For more concrete information of the operation of the circuit shown in FIG. 4, reference is to be made to Australian Pat. No. 488503.

With the control system for the tandem mill implemented according to the teaching of the invention disclosed in the foregoing, deviations in the strip thickness and the interstand tension can be suppressed to minimum, whereby a yield of the tandem mill as well as manipulatability there of are significantly improved, involving an enhanced production efficiency with a remarkably reduced operation energy consumption.

In the foregoing description, it has been assumed that the tension is determined arithmetically from the motor torque and the rolling force. However, it will be readily appreciated that the output signal from the tension detector employed in the cold tandem mill may be used directly as the tension signal. Further, the thickness detection may be effected by using an X-ray thickness gauge or the gauge which is operative based on the Hook's low. In the case of the mass flow gauge system operative on the basis of the low of constancy of mass flow, the delivered strip thickness may be arithmetically determined from the input thickness and the input feed speed.

The control system according to the present invention allows the dispersion of deviations in the strip thickness and the interstand tension to be controlled to minimum while the motor rotating speed control is effected in combination with the load control and the drive speed matching control. In the case of the hot tandem mill, the arithmetic determination of tension according to the invention can replace the hitherto employed looper, whereby mechanical control is no more required to a great advantage in respect of the accuracy, maintenance and energy consumption.

What is claimed is:

1. A control system for a continuous mill which incudes at least two rolling stands, comprising means for detecting delivered strip thicknesses of a strip-like material rolled and delivered from each of said rolling stands; means for detecting interstand tensions applied to said strip-like material between every two successive ones of said rolling stands; transfer means for shifting signals representing said delivered strip thicknesses at said rolling stands in dependence on the feeding speed of said strip-like material; means for setting desired values of said delivered strip thicknesses and said interstand tensions; and means for correctively controlling a roll gap or a roll rotation speed at each of said rolling stands on the basis of the detected thicknesses, the delivered strip thicknesses as shifted by said transfer means, the detected interstand tensions and desired values set for said delivered strip thicknesses and said interstand tensions so that dispersion of deviations in the detected thickness and tension from said desired values is reduced to a minimum within a succeeding predetermined time interval.

2. A control system according to claim 1, wherein said means for detecting delivered strip thickness at each of said rolling stands is adapted to correct successively forward slips between rolls and said strip-like material at said rolling stands on the basis of the output of at least the thickness gauge disposed between the first and the second rolling stands, the output signals produced from detectors each for detecting the rotating speed of the rolls at each of said rolling stands, the output signals from the interstand tension detecting means and said delivered thicknesses shifted by said transfer means, further including means for arithmetically determining the delivered strip thickness at each of said rolling stands on the basis of the low of constancy of mass flow, and means for removing previously known measurement error dispersions inherent to said thickness gauge and said rotating speed detecting means from said arithmetically determined thicknesses through filtering, thereby to output the filtered thickness values as the detected values.

3. A control system according to claim 1, wherein said means for detecting the interstand tension includes means for arithmetically determining each of said tensions on the basis of ratio between the rotating torque of a roll drive motor and a rolling force at each of said rolling stands and removing previously known measurement error dispersions inherent to said detecting means from said arithmetically determined tension value through filtering, whereby the values obtained after said filtering are output as the detected tension values.

4. A control system according to claim 1, wherein said means for correctively modifying the roll rotation speed includes means for correcting speed ratio between the adjacent rolling stands and supplying the corrected speed ratio to a speed controller which is adapted to determine a speed reference value at each of said rolling stands from said speed ratio by comparatively referring to the roll rotation speed of a predetermined one of said rolling stand, and means for controlling electric current supplied to the roll drive motors to control the rotation speeds thereof with the aid of sum signals each constituted by a signal produced by integrating difference between said reference value and the actual speed and a signal proportional to the output signal from a rolling load detector provided at each of said rolling stand.

* * * * *